US005887524A

United States Patent [19]

Seefried

[11] Patent Number: 5,887,524

[45] Date of Patent: Mar. 30, 1999

[54] WASHING DEVICE IN THE PRINTING UNIT OF ROTARY PRINTING PRESSES

[75] Inventor: Karl-Heinz Seefried, Zuzenhausen, Germany

[73] Assignee: Heidelberger Druckmaschinen Aktiengesellschaft, Heidelberg, Germany

[21] Appl. No.: 8,977

[22] Filed: Jan. 20, 1998

[30] Foreign Application Priority Data

Jan. 22, 1997 [DE] Germany ..... 197 02 082.8

[51] Int. Cl.[6] ..... B41F 35/00

[52] U.S. Cl. ..... 101/424; 101/425

[58] Field of Search ..... 101/424, 425, 101/423; 15/256.5, 256.51, 256.52

[56] References Cited

U.S. PATENT DOCUMENTS

| | | | |
|---|---|---|---|
| 2,648,088 | 8/1953 | Bailey | 101/425 |
| 3,737,940 | 6/1973 | Moestue et al. | 101/425 |
| 4,113,376 | 9/1978 | Rodda | 15/256.52 |
| 4,640,608 | 2/1987 | Higaya et al. | 15/256.51 |
| 4,664,505 | 5/1987 | Itaya et al. | 15/256.51 |
| 4,747,348 | 5/1988 | Jeschke et al. | 101/425 |
| 5,010,819 | 4/1991 | Uribe et al. | 101/425 |
| 5,035,178 | 7/1991 | Jahn et al. | 101/425 |

FOREIGN PATENT DOCUMENTS

| | | |
|---|---|---|
| 1270147 | 6/1990 | Canada . |
| 3614496 | 11/1987 | Germany . |
| 3810085 | 10/1989 | Germany . |
| 3909819 | 9/1990 | Germany . |
| 9403228 | 6/1994 | Germany . |
| 4343692 | 6/1995 | Germany . |
| 4426079 | 1/1996 | Germany . |
| 29518355 | 2/1996 | Germany . |
| 29612400 | 10/1996 | Germany . |
| 29620271 | 2/1997 | Germany . |

*Primary Examiner*—Edgar Burr
*Assistant Examiner*—Anthony H. Nguyen
*Attorney, Agent, or Firm*—Nils H. Ljungman & Associates

[57] ABSTRACT

A washing unit in the printing unit of rotary printing presses, with a driven brush roller. The brush roller can be brought into contact against the cylindrical surface of a cylinder to be cleaned. The washing unit also includes a cleaning agent feed device, a wiper on the brush roller and a housing to catch the dirty washing fluid ejected from the brush roller. The arrangement allows the washing unit to function correctly and reliably even when it is located above the cylindrical surface to be cleaned.

14 Claims, 1 Drawing Sheet

WASHING DEVICE IN THE PRINTING UNIT OF ROTARY PRINTING PRESSES

BACKGROUND OF THE INVENTION

1. Field of the Invention

The present invention relates to a washing unit in the printing unit of rotary printing presses, which washing unit includes a driven brush roller. The brush roller can be brought into contact against the cylindrical surface of a cylinder to be cleaned. The washing unit also includes a cleaning agent feed device, a wiper on the brush roller and a housing to catch the dirty washing fluid ejected from, or sprayed off by, the brush roller.

2. Background Information

In a similar known device (German Utility Model No. 94 03 228), the brush roller is provided below the cylindrical surface of a cylinder to be cleaned and is enclosed by a housing. The cleaning fluid in this known realization is sprayed into the brush roller by means of a spray tube which spray tube extends into the area occupied by the rotating bristles. There is also a wiper which is located ahead of the spray tube, seen in the direction of rotation of the brush roller, and which deflects the bristles and causes them to spring back, so that the dirty cleaning fluid is ejected or sprayed off. This known washing device can be used without problems in the lower portion of the cylinder to be cleaned. In the design of a printing unit, however, the space available or the layout of the equipment does not always make it possible to install the washing device in this location. For example, if such a washing device must be located above the cylinder to be cleaned, because such a location is necessitated by the space available in the machine, the dispensing of the correct quantity of washing fluid can lead to problems, i.e. the feed tubes can inadvertently run dry, or dripping fluid can result in problems with the printing process. If the feed tubes run dry, there will also be problems in the performance of the washing process which result from the failure to dispense the correct or required amount of washing agent. The location of valves on the spray nozzles would make the washing device significantly more expensive.

OBJECT OF THE INVENTION

The object of the present invention is to create a washing device which performs its function correctly without additional effort even when it is located above the cylindrical surface to be cleaned.

SUMMARY OF THE INVENTION

The present invention teaches that this object can be achieved with a solution wherein the wiper is located in the upper portion of the brush roller so that the wiper extends into the area occupied by the rotating bristles. The washing agent feed corresponds to or is connected to the wiper. The washing agent is applied to the wiper, and from there runs into the bristles. Also, the housing is located downstream of the wiper, viewed in the direction of rotation of the brush roller. This solution guarantees that the washing fluid will not drip, and that the washing fluid gets into the bristles of the brush roller, so that the dissolved particles of dirt can be reliably sprayed off the brush roller. This solution creates a simple and economical washing device which is altogether capable of meeting the exacting requirements of modern rotary printing presses.

In one advantageous embodiment of the present invention, the washing agent is delivered via one or more spray tubes with spray nozzles so that a correct dispensing action and a uniform distribution of the washing agent is guaranteed over the entire length of the brush roller.

In an additional advantageous embodiment of the present invention, the wiper is oriented at an angle in relation to the brush roller, and that the washing agent is applied to the upper side of the wiper. Consequently, the washing agent can be introduced into the brush roller in a precisely measured quantity, to prevent any unintentional ejection or splashing of the washing agent.

In an additional advantageous embodiment of the present invention, the housing is located next to the brush roller, and has an opening in the vicinity of the tips of the bristles. Using this solution, it becomes possible to provide a relatively small housing which takes up little space in the machine and is very easy to handle, e.g. for cleaning.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

One embodiment of the present invention is illustrated schematically in the accompanying figure, in which.

DESCRIPTION OF THE PREFERRED EMBODIMENT

Figure 1:
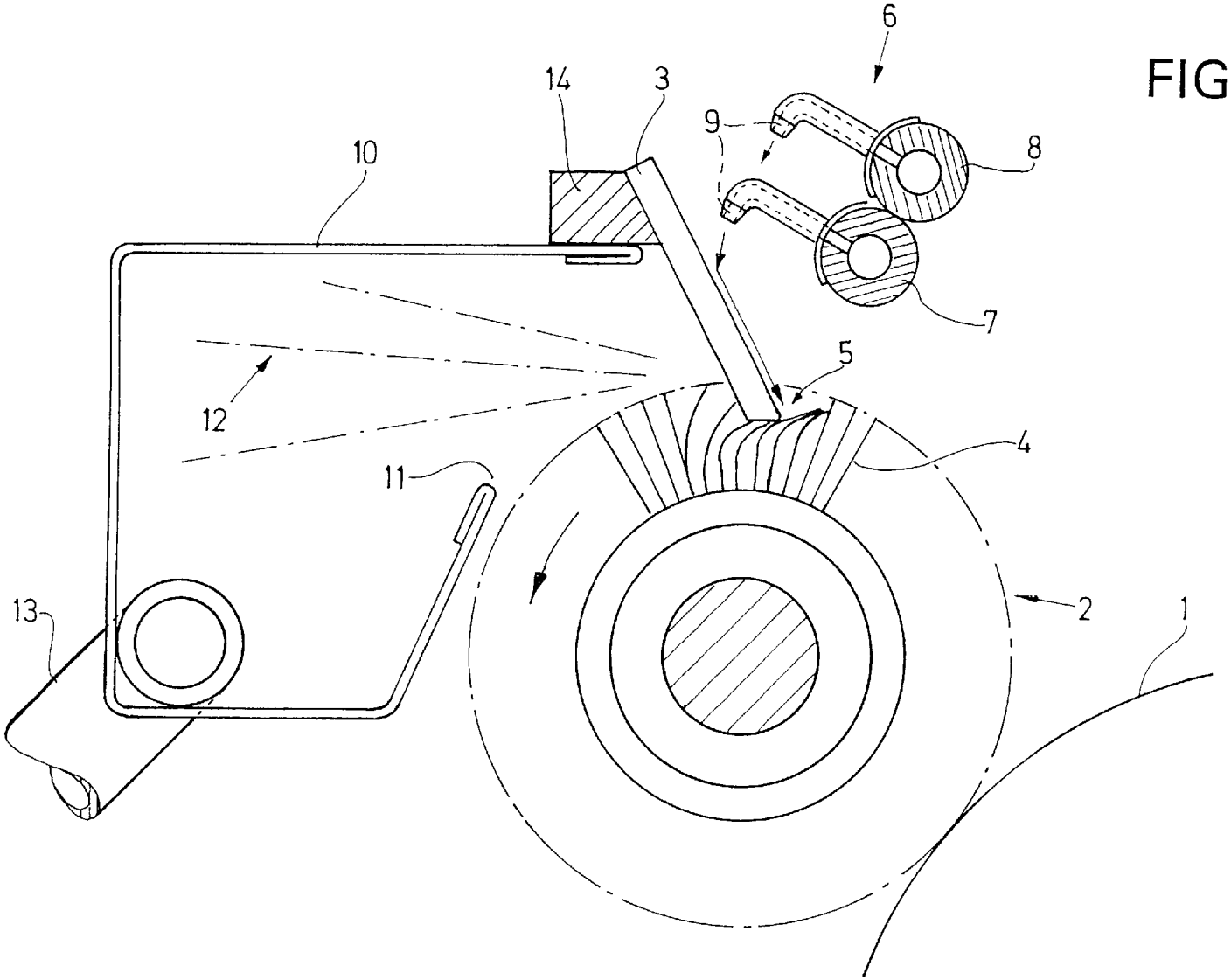
FIG. 1 shows a side view of an embodiment of the present invention.

Corresponding to or connected to the cylindrical surface of a cylinder 1 to be cleaned is a brush roller 2 with bristles 4, which brush roller 2 can be applied against the cylindrical surface for the washing process. For this purpose, the brush roller 2 is equipped with a drive system (not shown). Corresponding to the brush roller 2 there is also a wiper 3, which wiper 3 extends into the vicinity of the bristles 4 and deflects or bends the bristles (shown at 5). A washing agent feed 6, which washing agent feed 6 can include a tube 7 for washing agent and a tube 8 for water, also corresponds to the wiper 3 or, can be connected to the wiper 3. The washing agent or water can thereby be applied to the wiper 3 by a plurality of spray nozzles 9, and from there the washing agent or water runs into the bristles 4. It is advantageous if the wiper 3 is oriented at an angle in relation to the brush roller 2, so that the washing agent or water can be applied to the upper side of the wiper 3.

Located downstream of the brush roller 2, viewed in the direction of rotation of the brush roller 2, there is a housing 10. The housing 10 has an opening 11, which opening 11 is located in the vicinity of tips 12 of the bristles 4. When the brush roller 2 is in rotation, the bristles 4 are deflected by the wiper 3 and spray the contaminated washing agent into the housing 10, in which the washing agent is collected. If necessary, the housing 10 can have a discharge 13 by which the dirty washing agent can be removed. Both the wiper 3 and the housing 10 can be fastened to a mounting 14 and can be removed from the machine if necessary, e.g. for cleaning.

In one possible embodiment of the present invention, the brush roller 2 can remove ink or other contaminants from the cylinder 1 to be cleaned. The wiper 3, can then remove the ink or other contaminants which have been removed from the cylinder 1, from the brush roller 2, and project them through the opening 11 into the housing 10, by bending the bristles 4 back and then releasing them as the brush roller 2 rotates those bristles 4 first into contact with and then away from the wiper 3.

One feature of the invention resides broadly in the washing unit in the printing unit of rotary printing presses with a driven brush roller which can be brought into contact against the cylindrical surface of a cylinder to be cleaned, with a cleaning agent feed device, a wiper on the brush roller and with a housing to catch the dirty washing fluid ejected from the brush roller, characterized by the fact that the wiper 3 is provided in the upper portion of the brush roller 2, and extends into the area occupied by the rotating bristles 4, that the washing agent feed 6 corresponds to the wiper 3, that the washing agent is applied to the wiper 3 and from there it runs into the bristles 4, and that the housing 10 is located downstream of the wiper 3 viewed in the direction of rotation of the brush roller 2.

Another feature of the invention resides broadly in the washing device characterized by the fact that the washing agent is delivered via one or more spray tubes 7, 8 with spray nozzles 9.

Yet another feature of the invention resides broadly in the washing device characterized by the fact that the wiper is oriented at an angle in relation to the brush roller 2, and that the washing agent is applied on the upper side of the wiper.

Still another feature of the invention resides broadly in the washing device characterized by the fact that the housing 1 is located next to the brush roller 2 and has an opening 11 in the vicinity of the tips 12 of the bristles 4.

All, or substantially all, of the components and methods of the various embodiments may be used with at least one embodiment or all of the embodiments, if more than one embodiment is described herein.

All of the patents, patent applications and publications recited herein, are hereby incorporated by reference as if set forth in their entirety herein.

U.S. patent application No. 08/599,637, entitled "Drive for Distributor Rollers in an Inking Unit of a Rotary Printing Machine", filed on Feb. 9, 1996, and having the inventors Carsten Kelm and Rainer Klenk, is hereby expressly incorporated by reference as if set forth in its entirety herein.

Examples of rotary printing presses and devices to clean rotary printing presses or cylinders of rotary printing presses may be found in the following U.S. patent applications: Ser. No. 08/784402, Attorney Docket No. NHL-HBD-141, entitled "Device for Cleaning Cylinder Surfaces in Printing Presses", having the inventor Jens Friedrichs, and filed on Jan. 17, 1997; Ser. No. 08/801516, Attorney Docket No. NHL-HBD-144, entitled "Device For Cleaning Outer Cylindrical Surfaces of Cylinders in a Rotary Printing Machine", having the inventors Andre Geis and Thomas Kraft, filed on Feb. 18, 1997; Ser. No. 08/822590, Attorney Docket No. NHL-HBD-145, entitled "Cleaning Device Provided on a Rotary Printing Machine", having the inventors Willi Becker, Jens Friedrichs and Frank Kropp, filed on Mar. 20, 1997; Ser. No. 08/822250, Attorney Docket No. NHL-HBD-146, entitled "Cleaning Device Provided on a Rotary Printing Machine", having the inventors Willi Becker, Jens Friedrichs and Frank Kropp, filed on Mar. 20, 1997; and Ser. No. 08/854233, Attorney Docket No. NHL-HBD-155, entitled "Device and Method to Clean Cylinder Surfaces in Rotary Printing Presses", having the inventors Joachim Herrmann, Kurt Lotsch, Ralf Degner and Hendrik Stemmler, filed on May 9, 1997.

U.S. patent application Ser. No. 09/006,735, filed on or about Jan. 16, 1998, having the Attorney Docket No. NHL-HBD-159, having the inventor Karl-Heinz Seefried, entitled "Printing Unit of Rotary Printing Presses", and claiming priority from Federal Republic of Germany Patent Application No. 197 37 783.1, filed on Aug. 29, 1997, and Federal Republic of Germany Patent Application Ser. No. 297 00 662.2, filed on Jan. 16, 1997, is hereby expressly incorporated by reference as if set forth in its entirety herein.

The corresponding foreign patent publication applications, namely, Federal Republic of Germany Patent Application No. 197 02 082.8, filed on Jan. 22, 1997, having inventor Karl-Heinz Seefried, and DE-OS 197 02 082.8 and DE-PS 197 02 082.8, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A washing unit for the printing unit of a rotary printing press, said washing unit comprising:

a brush roller;

said brush roller being configured to rotate about an axis of rotation;

said brush roller being configured to be disposed to contact a cylinder of the printing press and being configured to clean the cylinder of the printing press;

said brush roller comprising a plurality of bristles;

a wiper being configured and disposed to wipe said plurality of bristles of said brush roller upon rotation of said brush roller;

said wiper being disposed above said brush roller;

said wiper being disposed to contact a changing portion of said plurality of bristles of said brush roller;

a cleaning agent feed device;

said cleaning agent feed device being disposed and configured to provide cleaning agent to said brush roller;

a housing;

said housing being disposed and configured to receive material cleaned from the cylinder to be cleaned, by said brush roller from said changing portion of said plurality of bristles of said brush roller, upon said wiper being removed from contact with said changing portion of said plurality of bristles;

said cleaning agent feed device being disposed and configured to provide cleaning agent to said wiper; and said wiper being configured to provide cleaning agent received from said cleaning agent feed device to said brush roller.

2. The washing unit according to claim 1 wherein said wiper is configured to provide cleaning agent received from said cleaning agent feed device to said changing portion of said plurality of bristles of said brush roller.

3. The washing unit according to claim 2 wherein said housing is disposed and configured to receive used cleaning agent from said brush roller.

4. The washing unit according to claim 3 wherein:

said brush roller has a direction of rotation about the axis of rotation;

said brush roller defines an upstream direction, said upstream direction is defined in a direction opposite to the direction of rotation;

said brush roller defines a downstream direction, said downstream direction is defined opposite to the upstream direction; and said housing is disposed downstream of said wiper.

5. The washing unit according to claim 4 wherein:

said plurality of bristles of said brush roller are disposed to project substantially transverse from said axis of rotation; and said wiper is disposed to deflect said changing portion of said plurality of bristles of said brush roller.

6. The washing unit according to claim 5 wherein said cleaning agent feed device comprises:

at least one spray tube; and at least one spray nozzle disposed on said at least one spray tube.

7. The washing unit according to claim 6 wherein:

said wiper has a first surface and a second surface disposed opposite to said first surface;

said second surface of said wiper is disposed to face said housing;

said first surface of said wiper is disposed and configured to contact said changing portion of said plurality of bristles of said brush roller at an angle with respect to said changing portion; and said cleaning agent feed device is disposed and configured to provide cleaning agent to said first surface of said wiper.

8. The washing unit according to claim 7 wherein:

said housing is disposed substantially adjacent to said brush roller; and said housing comprises an opening to receive used cleaning agent.

9. The washing unit according to claim 8 wherein:

each of said plurality of bristles comprises a tip; and said housing is disposed adjacent at least a portion of said tips of said plurality of bristles.

10. The washing unit according to claim 9 comprising:

a mounting structure; and said mounting structure being disposed and configured to mount said wiper on said housing.

11. The washing unit according to claim 10 wherein:

said housing comprises a discharge opening; and said discharge opening being disposed and configured to remove used cleaning agent from said housing.

12. In a rotary printing press, the rotary printing press comprising: a frame, a printing unit cylinder to mount a printing plate, the printing unit cylinder being rotatable mounted on said frame, an ink supply, and at least one additional cylinder to transfer ink from said ink supply to said printing unit cylinder; a washing unit; said washing unit comprising:

a brush roller;

said brush roller being configured to rotate about an axis of rotation;

said brush roller being configured to be disposed to contact a cylinder of the printing press and being configured to clean the cylinder of the printing press;

said brush roller comprising a plurality of bristles;

a wiper being configured and disposed to wipe said plurality of bristles of said brush roller upon rotation of said brush roller;

said wiper being disposed above said brush roller;

said wiper being disposed to contact a changing portion of said plurality of bristles of said brush roller;

a cleaning agent feed device;

said cleaning agent feed device being disposed and configured to provide cleaning agent to said brush roller;

a housing;

said housing being disposed and configured to receive material cleaned from the cylinder to be cleaned, by said brush roller from said changing portion of said plurality of bristles of said brush roller, upon said wiper being removed from contact with said changing portion of said plurality of bristles;

said brush roller having a direction of rotation about the axis of rotation;

said brush roller defining an upstream direction, said upstream direction being defined in a direction opposite to the direction of rotation;

said brush roller defining a downstream direction, said downstream direction being defined opposite to the upstream direction;

said housing being disposed downstream of said wiper;

said cleaning agent feed device being disposed and configured to provide cleaning agent to said wiper;

said wiper being configured to provide cleaning agent received from said cleaning agent feed device to said changing portion of said plurality of bristles of said brush roller; and said housing being disposed and configured to receive used cleaning agent from said brush roller.

13. The washing unit according to claim 12 wherein:

said plurality of bristles of said brush roller are disposed to project substantially transverse from said axis of rotation;

said wiper is disposed to deflect said changing portion of said plurality of bristles of said brush roller;

said cleaning agent feed device comprises:

at least one spray tube; and at least one spray nozzle disposed on said at least one spray tube;

said wiper has a first surface and a second surface disposed opposite to said first surface;

said second surface of said wiper is disposed to face said housing;

said first surface of said wiper is disposed and configured to contact said changing portion of said plurality of bristles of said brush roller at an angle with respect to said changing portion;

said cleaning agent feed device is disposed and configured to provide cleaning agent to said first surface of said wiper;

said housing is disposed substantially adjacent to said brush roller; and said housing comprises an opening to receive used cleaning agent.

14. The washing unit according to claim 13 comprising:

a mounting structure;

said mounting structure being disposed and configured to mount said wiper on said housing;

said housing comprising a discharge opening; and said discharge opening being disposed and configured to remove used cleaning agent from said housing.

* * * * *

UNITED STATES PATENT AND TRADEMARK OFFICE

CERTIFICATE OF CORRECTION

PATENT NO. : 5,887,524

DATED : March 30, 1999

INVENTOR(S) : Karl-Heinz SEEFRIED

It is certified that error appears in the above-indentified patent and that said Letters Patent is hereby corrected as shown below:

In column 5, line 66, Claim 12, after 'being', delete "rotatable" and insert --rotatably--.

Signed and Sealed this

Fourteenth Day of December, 1999

*Attest:*

Q. TODD DICKINSON

*Attesting Officer*

*Acting Commissioner of Patents and Trademarks*